US005642464A

United States Patent [19]

Yue et al.

[11] Patent Number: 5,642,464

[45] Date of Patent: Jun. 24, 1997

[54] METHODS AND APPARATUS FOR NOISE CONDITIONING IN DIGITAL SPEECH COMPRESSION SYSTEMS USING LINEAR PREDICTIVE CODING

[75] Inventors: H.S. Peter Yue, St. Laurent; Rafi Rabipour, Cote St. Luc, both of Canada

[73] Assignee: Northern Telecom Limited, Montreal, Canada

[21] Appl. No.: 433,116

[22] Filed: May 3, 1995

[51] Int. Cl.[6] ..... G10L 5/00

[52] U.S. Cl. ..... 395/2.24; 395/2.28; 395/2.71

[58] Field of Search ..... 395/2.09, 2.1, 395/2.2, 2.23, 2.24, 2.28, 2.35, 2.36, 2.71, 2.92; 375/240, 244, 249

[56] References Cited

U.S. PATENT DOCUMENTS

| | | | |
|---|---|---|---|
| 4,449,190 | 5/1984 | Flanagan et al. | 395/2.24 |
| 4,696,039 | 9/1987 | Doddington | 395/2.24 |
| 5,481,642 | 1/1996 | Shoham | 395/2.28 |
| 5,488,704 | 1/1996 | Fujimoto | 395/2.28 |

FOREIGN PATENT DOCUMENTS

WO94/17515 1/1994 WIPO .

OTHER PUBLICATIONS

"Convergence and Numerical Sensitivity of Backward--Adaptive LPC Predictors", Chen et al, Proc. IEEE Workshop on Speech Coding for Telecommunications, 1993, pp. 83–84.

"Improvements of Background Sound Coding in Linear Predictive Speech Coders", Wigren et al, International Conference for Acoustics, Speech and Signal Processing (ICASSP), Detroit, Michigan, May 9–12, 1995, pp. 25–28.

*Primary Examiner*—Benedict V. Safourek
*Attorney, Agent, or Firm*—C. W. Junkin

[57] ABSTRACT

In methods and apparatus for processing a speech signals comprising a plurality of successive signal intervals, each signal interval containing no speech sounds is classified as a noise interval, and LPC coefficients are calculated for each noise interval based on the samples of that noise interval and on the samples of a plurality of preceding signal intervals. When noise intervals encoded using LPC coefficients calculated as described above are reconstructed, the subjectively annoying "swishing" or "waterfall" effects encountered in conventional LPC speech processing systems are reduced or eliminated.

20 Claims, 8 Drawing Sheets

METHODS AND APPARATUS FOR NOISE CONDITIONING IN DIGITAL SPEECH COMPRESSION SYSTEMS USING LINEAR PREDICTIVE CODING

FIELD OF INVENTION

This invention relates to methods and apparatus for noise conditioning in digital speech compression systems using Linear Predictive Coding (LPC) techniques.

BACKGROUND OF INVENTION

In recent years, many speech transmission and speech storage applications have employed digital speech compression techniques to reduce transmission bandwidth or storage capacity requirements. Linear Predictive Coding (LPC) techniques provide good compression performance and have become particularly popular for such applications. Speech coding algorithms based on LPC techniques have been incorporated in wireless transmission standards including North American digital cellular standards IS-54 and IS-95, as well as the European Global System for Mobile Communications (GSM) standard.

LPC based speech coding algorithms represent speech signals as combinations of excitation waveforms and sequences of all pole filters which model effects of the human articulatory system on the excitation waveforms. The excitation waveforms and the filter coefficients can be encoded more efficiently than the input speech signal to provide a compressed representation of the speech signal.

To accommodate changes in spectral characteristics of the input speech signal, conventional LPC based codecs update the filter coefficients once every 10 ms to 30 ms (for wireless telephone applications, typically 20 ms). This rate of updating the filter coefficients has proven to be subjectively acceptable for the transmission of speech sounds, but can result in subjectively unacceptable distortions for background noise or other environmental sounds.

Such background noise is common in digital cellular telephony because mobile telephones are often operated in noisy environments. Users of digital cellular telephones report subjectively annoying "swishing" or "waterfall" sounds during non-speech intervals, or report the presence of background noise which "seems to be coming from under water".

The subjectively annoying distortions of noise and environmental sounds can be reduced by squelching or attenuating non-speech sounds. However, this approach also leads to subjectively annoying results. In particular, the absence of background noise during non-speech intervals often causes the caller to wonder whether the call has been dropped.

Alternatively, the distorted noise can be replaced by synthetic noise which does not have the annoying characteristics of noise processed by LPC based techniques. While this approach avoids the annoying characteristics of the distorted noise and does not convey the impression that the call may have been dropped, it eliminates transmission of background sounds that may contain information of value to the caller. Moreover, because the real background sounds are transmitted along with the speech sounds during speech intervals, this approach results in distinguishable and annoying discontinuities in the perception of background sounds at noise to speech transitions.

Another approach involves enhancing the speech signal relative to the background noise before any encoding of the speech signal is performed. This has been achieved by providing an array of microphones and processing the signals from the individual microphones according to noise cancellation techniques so as to suppress the background noise and enhance the speech sounds. While this approach has been used in some military, police and medical applications, it is currently too expensive for consumer applications. Moreover, it is impractical to build the required array of microphones into a small portable handset.

Definitions

In this specification, the term "LPC coefficients" is intended to refer to any set of coefficients which uniquely defines a filter function which models the human articulatory tract. In conventional LPC techniques, several different types of LPC coefficients are known, including reflection coefficients, arcsines of the reflection coefficients, line spectrum pairs, log area ratios, etc. These different types of LPC coefficients are related by mathematical transformations and have different properties which suit them to different applications. The term "LPC coefficients" is intended to encompass any of these types of coefficients.

The term "excitation parameters" is intended to refer to any set of parameters which uniquely defines an excitation waveform to be applied to a filter function to reconstruct a speech signal. The excitation parameters may include shapes, pitch periods, pitch lags, gains, relative gains, etc.

The term "speech interval" is intended to refer to any audio signal interval containing sounds identifiable as speech sounds by a speech detector, and the term "noise interval" is intended to refer to any audio signal interval containing no sounds identifiable as speech sounds by a speech detector.

SUMMARY OF INVENTION

An object of this invention is to reduce the annoying subjective effects of noise distortion by LPC based speech codecs while avoiding some or all of the disadvantages of the known techniques as outlined above.

One aspect of this invention provides a method for processing a speech signal comprising a plurality of successive signal intervals, each signal interval comprising a plurality of successive signal samples. The method comprises classifying each signal interval containing no speech sounds as a noise interval, and calculating LPC coefficients for each noise interval based on the samples of that noise interval and on the samples of a plurality of preceding signal intervals.

When noise intervals encoded using LPC coefficients calculated as described above are reconstructed, the subjectively annoying "swishing" or "waterfall" effects encountered in conventional LPC speech processing systems are reduced or eliminated.

In conventional LPC speech processing systems, the annoying "swishing" or "waterfall" effects are probably due to inaccurate modelling of the noise intervals which have relatively low energy or relatively flat spectral characteristics. The inaccuracies in modelling may manifest themselves in the form of spurious bumps or dips in the frequency response of the LPC synthesis filter derived from LPC coefficients derived in the conventional manner. Reconstruction of noise intervals using a rapid succession of inaccurate LPC synthesis filters may lead to unnatural modulation of the reconstructed noise.

The longer window used to calculate LPC coefficients in the speech processing method defined above increases the accuracy of the LPC model for signals that are more stationary than speech.

Synthesis filters derived from LPC coefficients calculated in the conventional manner also fail to roll off at high frequencies as sharply as would be required for a good match to noise intervals of the input signal. This shortcoming of the synthesis filter makes the reconstructed noise intervals more perceptible, accentuating the unnatural quality of the background sound reproduction. Accordingly, it is beneficial when processing the background sounds to attenuate the reconstructed signal at frequencies above approximately 3500 Hz by low pass filtering at an appropriate point in the speech processing operation.

Consequently, the method may further comprise low pass filtering the noise intervals of the speech signal to attenuate spectral components at frequencies greater than 3500 Hz relative to spectral components at frequencies below 3500 Hz.

The method may be performed as part of an LPC based speech encoding operation. In this case, the method further comprises classifying each signal interval containing speech sounds as a speech interval, calculating LPC coefficients for each speech interval based only on the samples of that speech interval, calculating excitation parameters for each speech interval based on the samples of that speech interval and the LPC coefficients calculated for the speech interval, calculating excitation parameters for each noise interval based on the samples of that noise interval and the LPC coefficients calculated for that noise interval, and combining the LPC coefficients and the excitation parameters calculated for each signal interval to encode that signal interval.

In this case, low pass filtering of the noise intervals may be achieved by modifying the LPC coefficients calculated for the noise intervals before combining the LPC coefficients with the excitation parameters to encode the speech intervals. Alternatively, the step of low pass filtering the noise intervals may be performed after decoding the noise intervals. The LPC coefficients calculated for the noise intervals may be used for calculating the excitation parameters for the noise intervals either before or after they are modified to provide low pass filtering.

The method may also be performed as part of an LPC decoding operation for reconstructing a speech signal from an LPC encoded waveform. In this case, the method further comprises reconstructing the noise intervals of the speech signal from the calculated LPC coefficients. The step of reconstructing the noise intervals of the speech signal may comprise low pass filtering the noise intervals of the speech signal either before or after reconstruction.

Another aspect of the invention provides apparatus for processing a speech signal comprising a plurality of successive signal intervals, each signal interval comprising a plurality of successive samples. The apparatus comprises processing means and storage means for storing instructions for operation of the processing means. The instructions implement functional blocks comprising a speech detector for distinguishing signal intervals containing speech sounds from signal intervals containing no speech sounds, and a long window LPC analyzer for calculating LPC coefficients for each signal interval containing no speech sounds based on the samples of that signal interval and on the samples of a plurality of preceding signal intervals.

To implement an LPC based speech encoder, the functional blocks may further comprise a short window LPC analyzer for calculating LPC coefficients for each signal interval containing speech sounds based only on the samples of that speech interval, an excitation analyzer for calculating excitation parameters for each signal interval based on the samples of that speech interval and the LPC coefficients calculated for that interval, and an encoder for combining the calculated LPC coefficients and the excitation parameters to encode each speech interval.

The functional blocks may further comprise a low pass filter for modifying the LPC coefficients calculated by the long window LPC analyzer to attenuate spectral components above 3500 Hz relative to spectral components below 3500 Hz.

Another aspect of the invention provides apparatus for processing an LPC encoded speech signal. The apparatus comprises processing means and storage means for storing instructions for operation of the processing means. The instructions implement functional blocks comprising a decoder for extracting LPC coefficients and excitation parameters for each of a plurality of successive signal intervals from an LPC encoded speech signal, a synthesis filter for reconstructing speech signal intervals from the extracted LPC coefficients and excitation parameters, a speech detector for distinguishing signal intervals containing speech sounds from signal intervals containing no speech sounds, and a low pass filter for attenuating spectral components of the signal intervals containing no speech sounds at frequencies greater than 3500 Hz relative to spectral components at frequencies lower than 3500 Hz.

Another aspect of the invention provides apparatus for processing an LPC encoded speech signal, the apparatus comprising processing means and storage means for storing instructions for operation of the processing means. The instructions implement functional blocks comprising a decoder for extracting LPC coefficients and excitation parameters for each of a plurality of successive signal intervals from an LPC encoded speech signal, a speech detector for distinguishing signal intervals containing speech sounds from signal intervals containing no speech sounds, a long window LPC analyzer for calculating LPC coefficients for each signal interval containing no speech sounds based on characteristics of that signal interval and on characteristics of a plurality of preceding signal intervals, and a synthesis filter for reconstructing speech signal intervals containing speech sounds from the extracted LPC coefficients and excitation parameters and for reconstructing speech signal intervals containing no speech sounds from the calculated LPC coefficients and the extracted excitation parameters.

The synthesis filter may comprise a first synthesis filter element and a second synthesis filter element, the first synthesis filter element being operable to reconstruct speech signal intervals from the extracted LPC coefficients and excitation parameters. The long window LPC analyzer may be operable to calculate the LPC coefficients from the reconstructed speech signal intervals. The second synthesis filter element may be operable to reconstruct speech signal intervals from the calculated LPC coefficients and the extracted excitation parameters. The functional blocks may further comprise a selector responsive to the speech detector for selecting between the speech signal intervals reconstructed from the extracted LPC coefficients and excitation parameters and the speech signal intervals reconstructed from the calculated LPC coefficients and the extracted excitation parameters. The functional blocks may further comprise a low pass filter operable to low pass filter the speech signal intervals reconstructed from the calculated LPC coefficients and the extracted excitation parameters.

Alternatively, the long window LPC analyzer may be operable to compute the LPC coefficients for each signal interval containing no speech sounds from the extracted LPC coefficients for that signal interval and the extracted LPC coefficients for each of a plurality of preceding signal intervals, and the functional blocks may further comprise a selector responsive to the speech detector for selecting between the extracted LPC coefficients and the calculated LPC coefficients for application to the synthesis filter. The functional blocks may further comprise a low pass filter operable to low pass filter the speech signal intervals reconstructed from the calculated LPC coefficients and the extracted excitation parameters, and another selector responsive to the speech detector to select between the low pass filtered reconstructed signal intervals and unfiltered reconstructed signal intervals.

Yet another aspect of the invention provides a method for processing a speech signal comprising a plurality of successive signal intervals, each signal interval comprising a plurality of successive signal samples. The method comprises classifying each signal interval containing no speech sounds as a noise interval and classifying each signal interval containing speech sounds as a speech interval. LPC coefficients are calculated for each speech interval based on a respective first plurality of samples comprising the samples of that speech interval. Excitation parameters are calculated for each speech interval based on the samples of that speech interval and the LPC coefficients calculated for that speech interval. LPC coefficients are calculated for each noise interval based on a respective second plurality of samples comprising the samples of that noise interval and a plurality of preceding signal intervals. Excitation parameters are calculated for each noise interval based on the samples of that noise interval and the LPC coefficients calculated for that noise interval. Each respective second plurality of samples contains at least ten times as many samples as each respective first plurality of samples.

BRIEF DESCRIPTION OF DRAWINGS

Embodiments of the invention are described below by way of example only. Reference is made to accompanying drawings in which.

DETAILED DESCRIPTION

Figure 1:
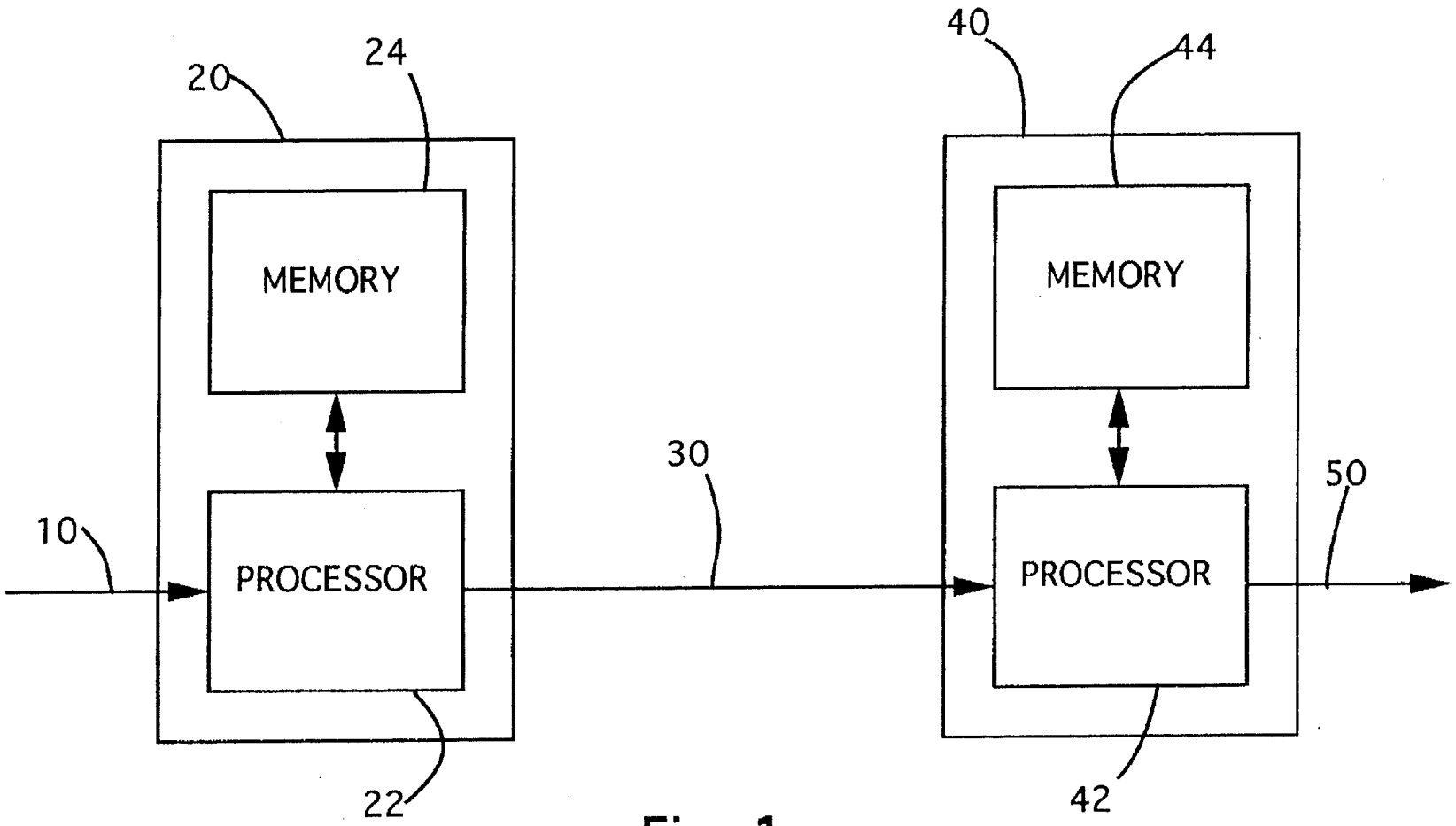
FIG. 1 is a block schematic diagram of apparatus used to implement the invention in a speech transmission application.

FIG. 1 is a block schematic diagram of apparatus used to implement the invention in a speech transmission application. The apparatus comprises an input signal line 10, an LPC speech encoder 20, a transmission path 30, an LPC speech decoder, and an output signal line 50. The LPC speech encoder 20 comprises a processor 22 and a memory 24 for storing instructions for operation of the processor 22 and for storing data used by the processor 22 in executing those instructions. Similarly, the LPC speech decoder 40 comprises a processor 42 and a memory 44 for storing instructions for operation of the processor 42 and for storing data used by the processor 42 in executing those instructions.

In operation of the apparatus of FIG. 1, a digital speech signal is applied to the input signal line 10. The processor 22 of the LPC speech encoder 20 executes instructions stored in the memory 24 to derive LPC coefficients and excitation parameters from the digital speech signal. The processor 22 executes further instructions stored in the memory 24 to encode the LPC coefficients and excitation parameters for transmission on the transmission path 30 to the LPC speech decoder 40. The encoding of the LPC coefficients and excitation parameters is such as to require less bandwidth than the input digital speech signal. The processor 42 of the LPC speech decoder 40 executes instructions stored in the memory 44 to extract the LPC coefficients and excitation parameters from the received signal and to reconstruct the input digital speech signal for application to the output signal line 50.

FIG. 1 illustrates only the apparatus needed to transmit encoded speech signals in one direction. Similar apparatus is needed to transmit encoded speech signals in the opposite direction for bidirectional transmission. The transmission path 30 will normally include transmitters and receivers which are not shown for simplicity. The nature of the transmitters and receivers will depend on the nature of the transmission path, which may comprise a conductive transmission line, an optical transmission line, a radio link or any other type of transmission path. Moreover, because the encoded speech signals are compressed to reduce transmission bandwidth, the transmission path 30 may include multiplexers and demultiplexers for the transmission of multiple encoded speech signals on a common transmission path 30. The multiplexers and demultiplexers are also not shown for simplicity.

Figure 2:
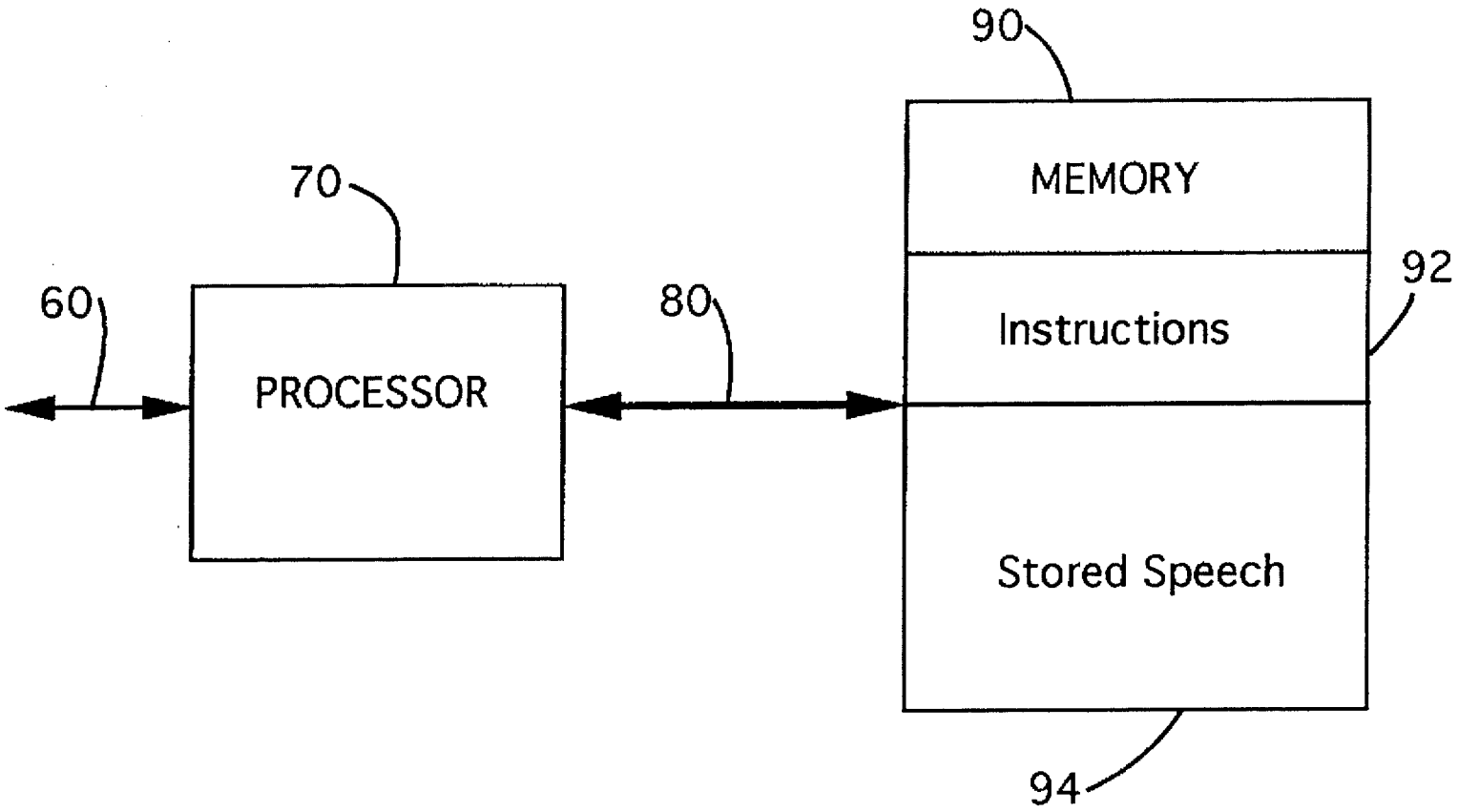
FIG. 2 is a block schematic diagram of apparatus used to implement the invention in a speech storage application.

FIG. 2 is a block schematic diagram of apparatus used to implement the invention in a speech storage application. This apparatus comprises an input/output bus 60, a processor 70, a memory bus 80 and a memory 90 partitioned into an instruction region 92 and a speech storage region 94.

In operation of the apparatus of FIG. 2, an input digital speech signal is applied to the input/output bus 60. The processor 70 executes instructions stored in the memory 90 to derive LPC coefficients and excitation parameters from the digital speech signal. The processor 70 executes further instructions stored in the memory 40 to encode the LPC coefficients and excitation parameters for transmission on the memory bus 80 to the memory 90. The encoding of the LPC coefficients and excitation parameters is such as to require less storage capacity in the memory 90 than the input digital speech signal. To retrieve the stored speech, the processor 70 executes instructions stored in the memory 90 to read the encoded speech data from the memory 90, extract the LPC coefficients and excitation parameters from the encoded speech data, and to reconstruct the input digital speech signal for application to the input/output bus 60.

Figure 3:
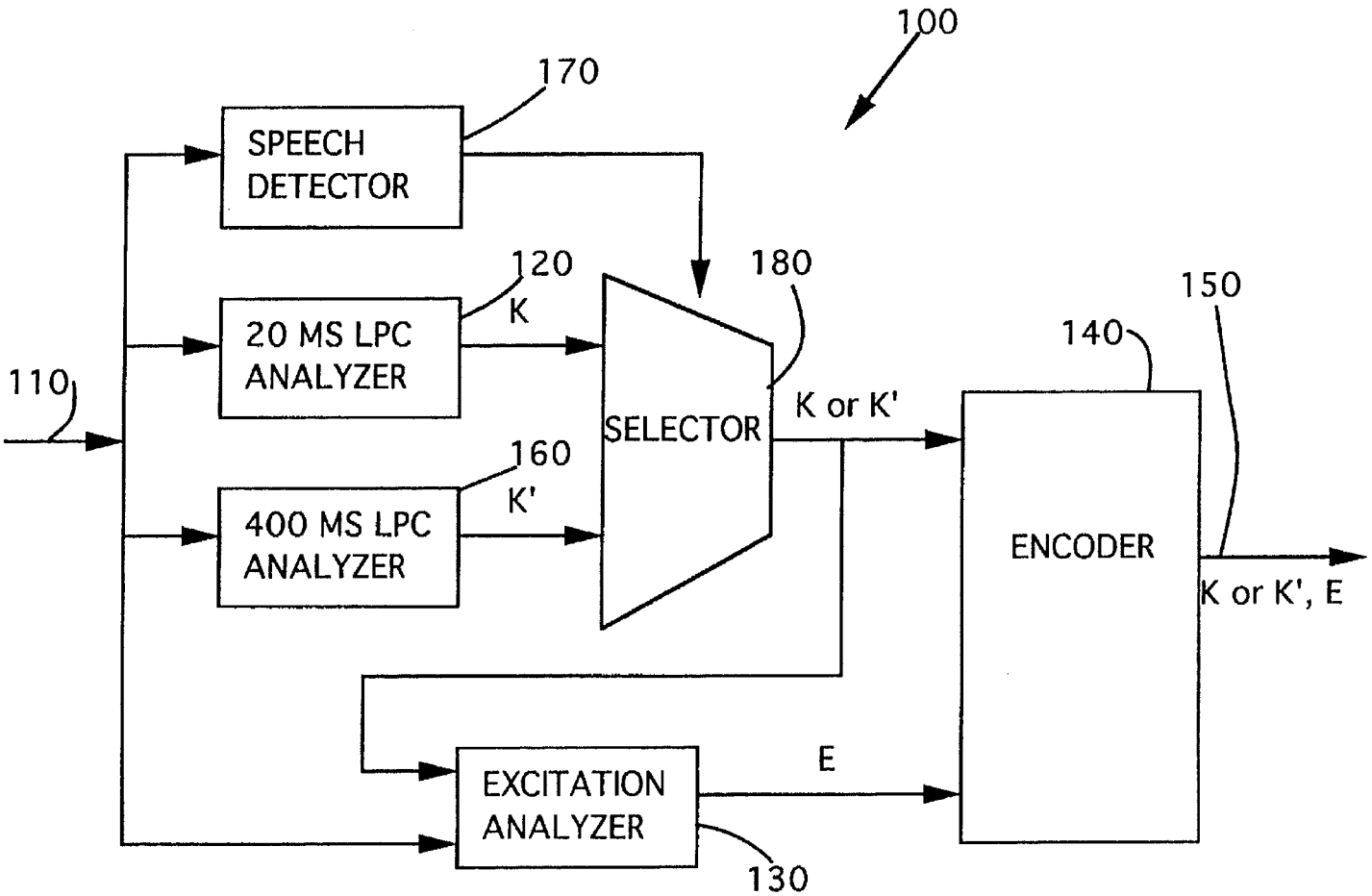
FIG. 3 is a block schematic diagram showing functional blocks of an LPC speech encoder according to an embodiment of the invention.

The LPC encoder 20 of FIG. 1 and the LPC encoding functions of the apparatus of FIG. 2 can be represented as an assembly of functional blocks as shown in FIG. 3. The functional blocks of the LPC encoder 100 include an input signal line 110, a 20 ms LPC analyzer 120, an excitation analyzer 130 and an encoder 140, and an output signal line 150, all of which are present in a conventional LPC speech encoder.

In a conventional LPC speech encoder, the 20 ms LPC analyzer 120 analyzes each 20 ms frame of a digital speech signal applied to the input signal line 110 to derive a set K of LPC coefficients. The set K of LPC coefficients models the vocal tract of the human articulatory system which produced the speech signal of that 20 ms interval as a digital filter. The excitation analyzer 130 also analyzes each 20 ms frame of the digital speech signal using the set K of LPC coefficients to derive a set E of excitation parameters which model waveforms upon which the human articulatory system operated during the 20 ms interval as a combination of excitation waveforms. The set K of LPC coefficients and the set E of excitation parameters are applied to the encoder 140 which combines the two sets into a common encoded signal for application to the output line 150.

As discussed in some detail above, conventional LPC speech encoders provide good performance on human speech but produce subjectively annoying effects when encoding non-speech background noise.

The LPC encoder 100 further comprises a 400 ms LPC analyzer 160, a speech detector 170 and a selector 180 which are not found in conventional LPC speech encoders. The 400 ms LPC analyzer 160 analyzes each 20 ms frame of the digital speech signal in conjunction with the preceding 19 frames of the digital speech signal to derive a set K' of LPC coefficients. The set K' of LPC coefficients provides a filter model which fluctuates less over several successive 20 ms intervals than the set K of LPC coefficients derived by the 20 ms LPC analyzer.

The speech detector 170 may be any of a number of known forms of speech detector which distinguishes intervals in the digital speech signal which contain speech sounds from intervals which contain no speech sounds. Examples of such speech detectors are disclosed in Rabiner et al, "An Algorithm for Determining the Endpoints of Isolated Utterances", Bell System Technical Journal, Vol. 54, No. 2, February 1975 and in copending U.S. patent application. The speech detector 170 may operate on the input digital speech signal, as shown in FIG. 1, or on the LPC coefficients K and excitation parameters E to distinguish those 20 ms frames of the digital speech signal that contain speech sounds from those 20 ms frames of the digital speech signal that contain no speech sounds.

The speech detector 170 operates the selector 180 to select the set K of LPC coefficients derived by the 20 ms LPC analyzer for those 20 ms frames that contain speech sounds and to select the set K' of LPC coefficients derived by the 400 ms LPC analyzer for those 20 ms frames that contain only non-speech background sounds. The selected set of LPC coefficients is applied to both the excitation analyzer 130 and the encoder 140. The excitation analyzer uses the selected set of LPC coefficients in the derivation of the excitation parameters. The encoder 140 encodes the selected set of LPC coefficients together with the excitation parameters to produce the LPC encoded speech signal.

The LPC speech encoder 100 and the LPC encoding process used in its operation have been found to reduce subjectively annoying characteristics of background noise as described above.

Figure 4:
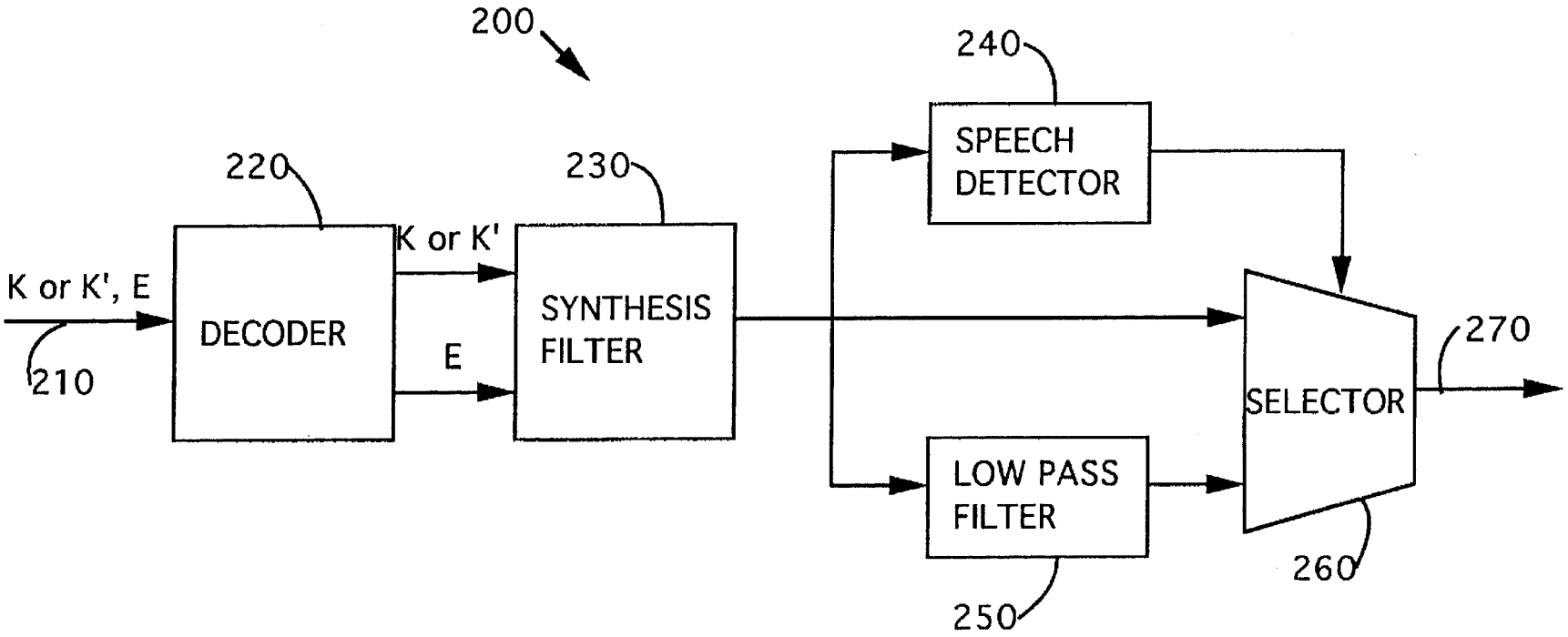
FIG. 4 is a block schematic diagram showing functional blocks of an LPC speech decoder according to an embodiment of the invention for use with the LPC speech encoder of FIG. 3.

FIG. 4 is a block schematic diagram showing functional blocks of an LPC speech decoder 200 for use with the LPC speech encoder 100 of FIG. 1. The LPC speech decoder 200 includes an input signal line 210, a decoder 220 and a synthesis filter 230, all of which are present in a conventional LPC speech decoder. In a convention LPC speech decoder, the decoder 220 extracts the LPC coefficients (K or K') and the excitation parameters (E) from the encoded signal received on the input signal line 210 for application to the synthesis filter 230. The synthesis filter 230 reconstructs the digital speech signal from the LPC coefficients and the excitation parameters.

As discussed above, the synthesis filter 230 does not generally roll off fast enough at high frequencies to provide an accurate construction of non-speech background noise, thereby contributing to subjectively annoying characteristics of the background noise.

In addition to functional blocks provided in conventional LPC speech decoders, the LPC speech decoder 200 includes a speech detector 240, a low pass filter 250 and a selector 260. The speech detector 240 distinguishes 20 ms frames in the reconstructed digital speech signal which contain speech sounds from 20 ms frames which contain no speech sounds. The speech detector 240 controls the selector 260 to select an unfiltered version of the reconstructed digital speech signal for frames containing speech sounds. The low pass filter 250 attenuates the reconstructed digital speech above 3500 Hz, and the speech detector 240 controls the selector 260 to select the low pass filtered version of the reconstructed digital speech signal for frames containing no speech sounds. The low pass filtering of the frames containing no speech sounds has been found to further reduce subjectively annoying characteristics of transmitted background noise.

The improved LPC speech encoding and decoding techniques described above are particularly beneficial in wireless telephony applications because relatively high levels of background noise are present in such applications, and LPC speech coding techniques are commonly used. However, implementation of the improved techniques as illustrated in FIGS. 1 and 2 would require modification of LPC codecs both in base stations and in mobile telephones. While wireless network operators may be prepared to upgrade their base stations to provide improved performance, subscribers may be reluctant to upgrade their mobile telephones. Consequently, for this application it is advantageous to provide LPC speech encoders which provide the selectable low pass filtering function of the LPC speech encoder 200 of FIG. 2, and to provide LPC speech decoders which provide the selectable LPC analysis window length functions of the LPC speech encoder 100 of FIG. 1.

Figure 5:
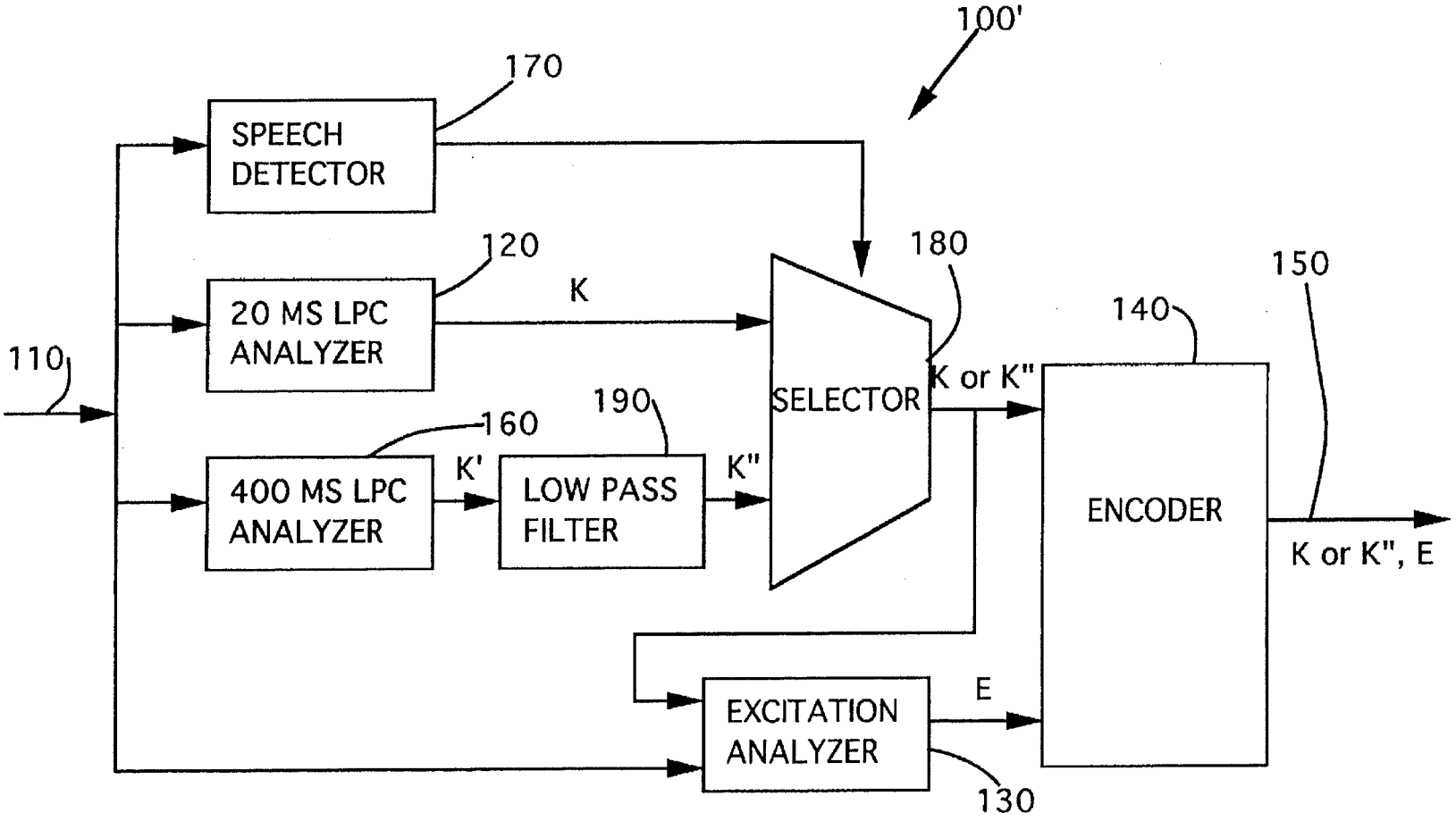
FIG. 5 is a block schematic diagram showing functional blocks of an LPC speech encoder according to an alternative embodiment of the invention for use with a conventional LPC speech decoder.

FIG. 5 is a block schematic diagram showing functional blocks of an LPC speech encoder 100' which includes a selectable low pass filtering function. In addition to the functional blocks of the LPC speech encoder 100 of FIG. 1, the LPC speech encoder 100' includes a low pass filter functional block 190 which transforms the set K' of LPC coefficients provided by the 400 ms LPC analyzer 160 to a set K" of modified LPC coefficients, the modification being such as to attenuate spectral components above 3500 Hz. For example, the set K" of modified LPC coefficients may be calculated by computing the impulse response of the synthesis filter defined by the set K' of LPC coefficients, applying the desired low pass filter function to that impulse response and calculating the set K" of LPC coefficients from the resulting waveform. LPC analysis based on a 20 ms frame is adequate for the calculation of the set K" of LPC coefficients because the impulse response of the synthesis filter defined by the set K' of LPC coefficients dies out quite rapidly.

Because the low pass filter function is applied at the output of the 400 ms LPC analyzer, the selection operation of the speech detector 170 ensures that low pass filtering is selectively applied only to frames of the speech signal that contain no speech sounds.

Figure 6:
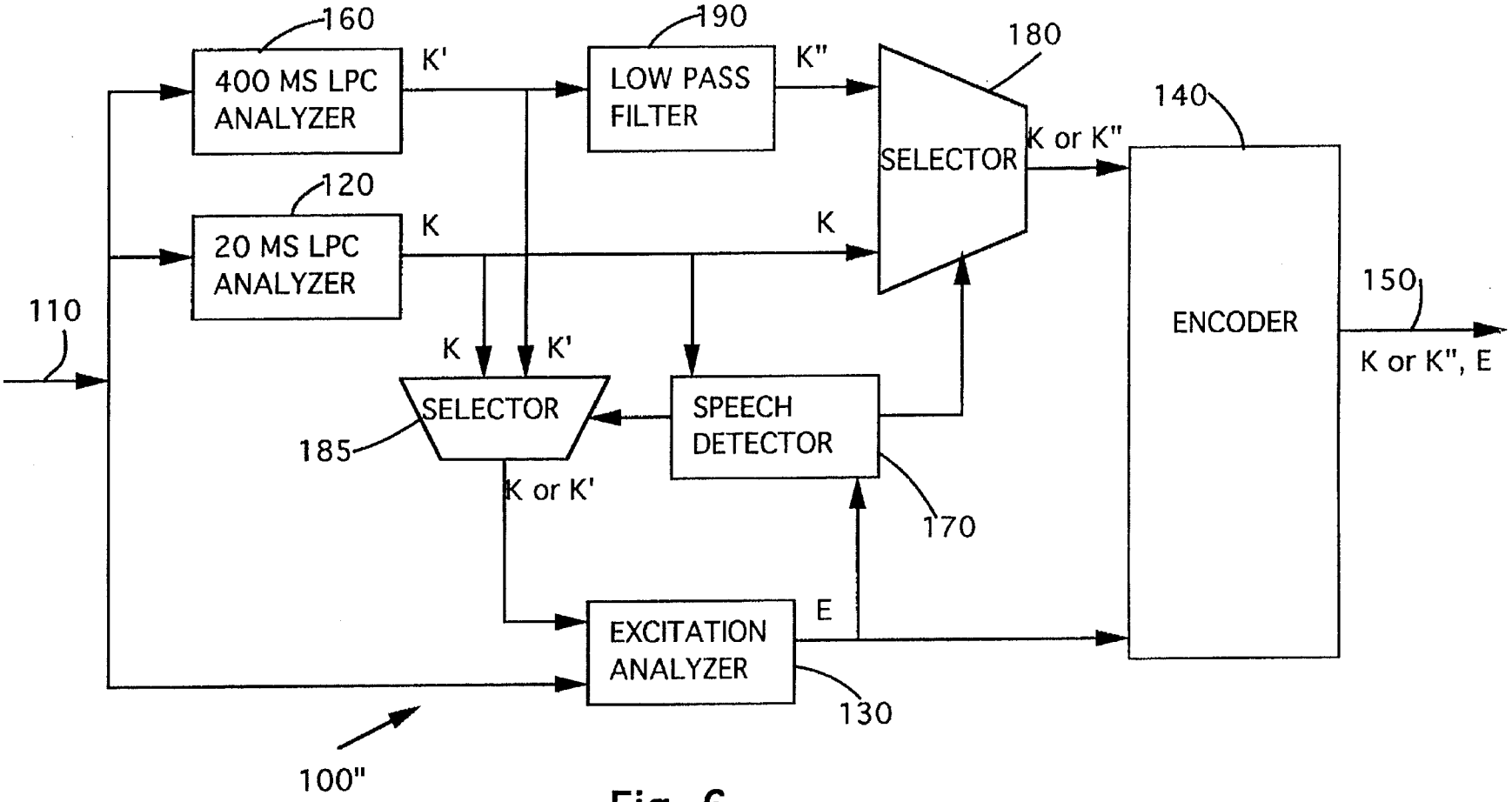
FIG. 6 is a block schematic diagram showing functional blocks of an LPC speech encoder according to another alternative embodiment of the invention for use with a conventional LPC speech decoder.

In the LPC speech encoder 100' of FIG. 5, the LPC coefficients applied to the excitation analyzer 130 are either the set K provided by the 20 ms LPC analyzer 120 or the set K" derived by low pass filtering the set K' provided by the 400 ms LPC analyzer 160. FIG. 6 is a block schematic diagram showing functional blocks of another LPC speech encoder 100" in which the LPC coefficients applied to the excitation analyzer 130 are either the set K provided by the 20 ms LPC analyzer 120 or the set K' provided by the 400 ms LPC analyzer 160. This LPC speech encoder 100" is similar to the LPC speech encoder 100' of FIG. 5 except that an additional selector 185 is provided to select between sets K and K' for application to the excitation analyzer 130. The additional selector 185 is driven by the speech detector 130 which, in this implementation, is shown operating on the set K of LPC coefficients and the set E of excitation parameters rather than operating on the input speech signal.

Figure 7:
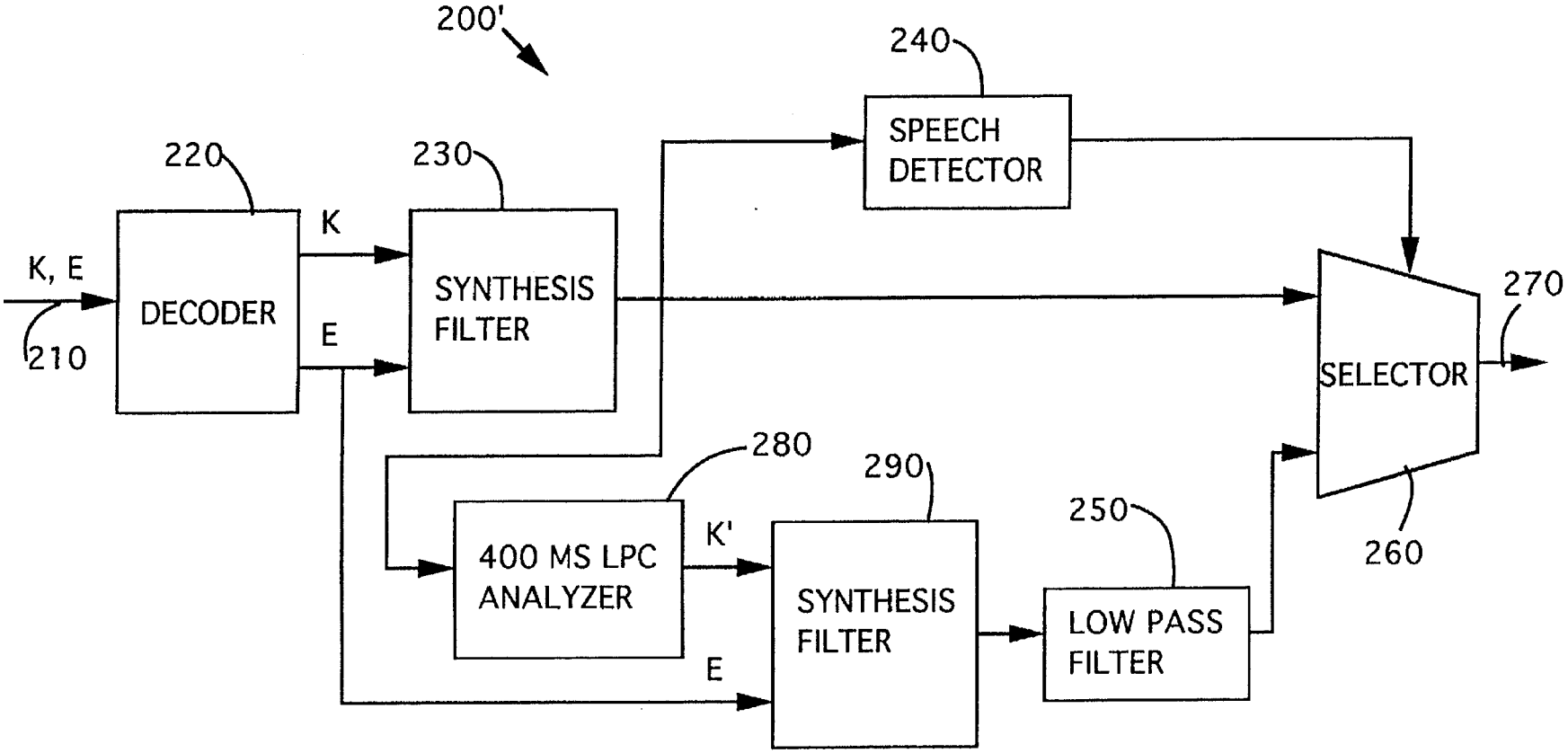
FIG. 7 is a block schematic diagram showing functional blocks of an LPC speech decoder according to an alternative embodiment of the invention for use with a conventional LPC speech encoder.

FIG. 7 is a block schematic diagram showing functional blocks of an LPC speech decoder 200' which provides selectable LPC analysis window length functions. In addition to the functional blocks of the LPC speech decoder 200 of FIG. 2, the LPC speech decoder 200' includes a 400 ms LPC analyzer 280 and an additional synthesis filter 290. The 400 ms LPC analyzer operates on frames of the reconstructed speech signal to derive the set K' of LPC coefficients. The set K' of LPC coefficients is applied to the additional synthesis filter 290 together with the excitation parameters E to provide another reconstruction of the speech signal which is low pass filtered and provided to the selector 260. The speech detector 240 causes the selector 260 to select the speech signal which has been reconstructed from the set K' of LPC coefficients by the additional synthesis filter 290 only for frames containing no speech sounds. For frames containing speech sounds, the speech detector 240 causes the selector 260 to select the speech signal which was reconstructed by the synthesis filter 230 from the set K of LPC coefficients received by the decoder 220.

Figure 8:
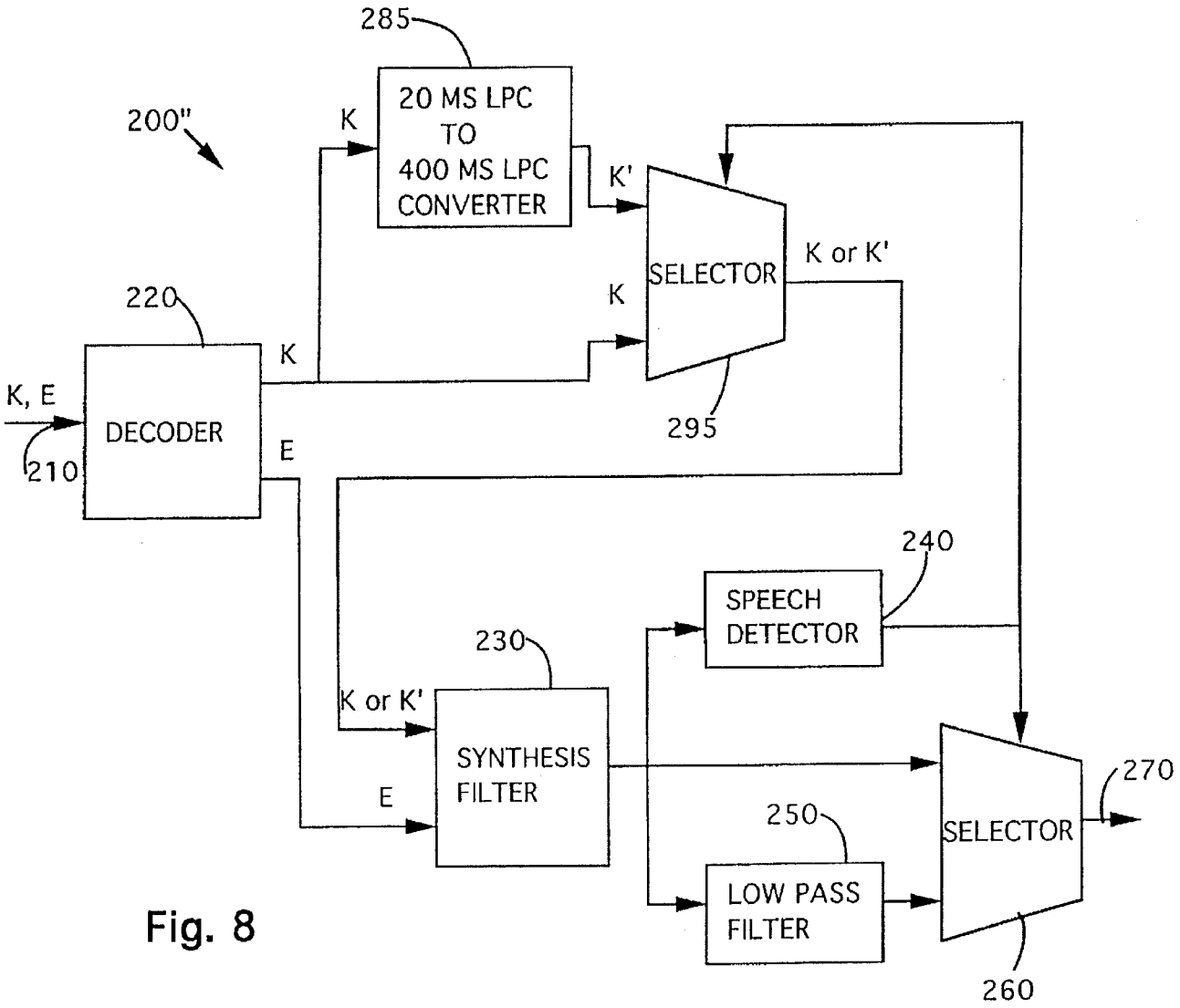
FIG. 8 is a block schematic diagram showing functional blocks of an LPC speech decoder according to another alternative embodiment of the invention for use with a conventional LPC speech encoder.

FIG. 8 is a block schematic diagram showing functional blocks of an LPC speech decoder 200" having an alternative implementation of the selectable analysis window length functions. In addition to the functional blocks of the LPC speech decoder 200 of FIG. 2, the LPC speech decoder 200" comprises a 20 ms LPC to 400 ms LPC converter 285 and an additional selector 295. The 20 ms LPC to 400 ms LPC converter 285 converts the sets K of LPC coefficients extracted by the decoder 220 to sets K' of LPC coefficients, each set K' being calculated from the set K for the current 20 ms frame and the sets K for 19 previous frames so that the sets K' represent the signal characteristics over 20 consecutive 20 ms frames. For example, the $j^{th}$ component x'(j,n) of the set K' for the $n^{th}$ 20 ms frame may be given by:

$$x'(jn) = \left(\frac{1}{N}\right) \sum_{i=0}^{N-1} [w(i)*x(jn-i)]$$

where x(j,i) is the $j^{th}$ component of the set K for the $i^{th}$ 20 ms frame, N=20 is the number of frames over which the modified LPC parameters are to be calculated, and w(i) is a weighting factor between zero and unity.

The sets K and K' are applied to the additional selector 295 which is driven by the speech detector 260 to apply the set K to the synthesis filter 230 for frames containing speech sounds and to apply the set K' to the synthesis filter 230 for frames containing no speech sounds.

The embodiments described above may be modified without departing from the principles of the invention.

For example, the speech detectors 170, 240 as illustrated in all figures operate on digital speech signals to distinguish frames containing speech sounds from frames containing no speech sounds. However, the speech detectors 170, 240 may alternatively operate on selected LPC coefficients or excitation parameters derived from the digital speech signals, or on selected combinations of LPC coefficients and excitation parameters, to distinguish frames containing speech sounds from frames containing no speech sounds.

These and other modifications are within the scope of the invention as defined by the claims below.

We claim:

1. A method for processing a speech signal comprising a plurality of successive signal intervals, each signal interval comprising a plurality of successive signal samples, the method comprising:

classifying each signal interval containing no speech sounds as a noise interval;

classifying each signal interval containing speech sounds as a speech interval;

calculating long window LPC coefficients for each noise interval based on the samples of that noise interval and a plurality of preceding signal intervals;

calculating excitation parameters for each noise interval based on the samples of that noise interval and the long window LPC coefficients calculated for that noise interval;

calculating short window LFC coefficients for each speech interval based only on the samples of that speech interval;

calculating excitation parameters for each speech interval based on the samples of that speech interval and the short window LPC coefficients calculated for that speech interval; and combining the LPC coefficients and the excitation parameters calculated for each signal interval to encode that signal interval.

2. A method as defined in claim 1, wherein:

each signal interval has a duration of 20 ms; and the step of calculating LPC coefficients for each noise interval comprises calculating LPC coefficients based on the samples of that noise interval and on the samples of n preceding signal intervals, where n is an integer between 10 and 30.

3. A method as defined in claim 1, further comprising low pass filtering the noise intervals of the speech signal to attenuate spectral components at frequencies greater than 3500 Hz relative to spectral components at frequencies below 3500 Hz.

4. A method as defined in claim 3, further comprising decoding the encoded speech intervals and the encoded noise intervals, wherein the step of low pass filtering the noise intervals is performed after decoding the noise intervals.

5. A method as defined in claim 3, wherein the step of low pass filtering the noise intervals comprises modifying the LPC coefficients calculated for the noise intervals before combining the LPC coefficients with the excitation parameters to encode the noise intervals.

6. A method as defined in claim 5, wherein the step of modifying the LPC coefficients is performed after the LPC coefficients are used to calculate the excitation parameters.

7. A method as defined in claim 5, wherein the step of modifying the LPC coefficients is performed before the LPC coefficients are used to calculate the excitation parameters.

8. A method as defined in claim 1, wherein:

the speech signal is a speech signal reconstructed from an LPC encoded waveform;

the method further comprising reconstructing the noise intervals of the speech signal from the calculated LPC coefficients.

9. A method as defined in claim 8, wherein the step of reconstructing the noise intervals of the speech signal comprises low pass filtering the noise intervals of the speech signal.

10. A method as defined in claim 8, further comprising low pass filtering the reconstructed noise intervals.

11. Apparatus for processing a speech signal comprising a plurality of successive signal intervals, each signal interval comprising a plurality of successive samples, the apparatus comprising processing means and storage means for storing instructions for operation of the processing means, said instructions implementing functional blocks comprising:

a speech detector for distinguishing signal intervals containing speech sounds from signal intervals containing no speech sounds;

a short window LPC analyzer for calculating LPC coefficients for each signal interval containing speech sounds based only on the samples of that speech interval;

a long window LPC analyzer for calculating LPC coefficients for each signal interval containing no speech sounds based on the samples of that signal interval and on the samples of a plurality of preceding signal intervals;

an excitation analyzer for calculating excitation parameters for each signal interval based on the samples of that signal interval and the LPC coefficients selected for that signal interval; and an encoder for combining the LPC coefficients and the excitation parameters calculated for each signal interval to encode each signal interval.

12. Apparatus as defined in claim 11, wherein:

the short window LPC analyzer is operable to calculate LPC coefficients based on individual 20 ms signal intervals; and the long window LPC analyzer is operable to calculate LPC coefficients based on n successive 20 ms signal intervals, where n is an integer between 10 and 30.

13. Apparatus as defined in claim 11, wherein the functional blocks further comprise a low pass filter for modifying the LPC coefficients calculated by the long window LPC analyzer to attenuate spectral components above 3500 Hz relative to spectral components below 3500 Hz.

14. Apparatus for processing an LPC encoded speech signal, the LPC encoded speech signal comprising a plurality of successive encoded signal intervals, each signal interval comprising a respective set of LPC coefficients and a respective set of excitation parameters representing the speech signal over a respective time interval, the apparatus comprising processing means and storage means for storing instructions for operation of the processing means, said instructions comprising:

a decoder for extracting LPC coefficients and excitation parameters for each successive encoded signal interval from the LPC encoded speech signal;

a synthesis filter for reconstructing speech signal intervals from the extracted LPC coefficients and excitation parameters, each reconstructed speech signal interval comprising a plurality of successive signal samples;

a speech detector for distinguishing reconstructed speech signal intervals containing speech sounds from reconstructed speech signal intervals containing no speech sounds; and a low pass filter for attenuating spectral components of at least the reconstructed speech signal intervals containing no speech sounds at frequencies greater than 3500 Hz relative to spectral components of the reconstructed speech signal intervals at frequencies less than 3500 Hz, the low pass filter being switchable into an output signal path in response to detection by the speech detector of a reconstructed speech signal interval containing no speech sounds to provide an output speech signal interval processed by the low pass filter and being switchable out of the output signal path in response to detection by the speech detector of a reconstructed speech signal interval containing speech sounds to provide an output speech signal interval not processed by the low pass filter.

15. Apparatus for processing an LPC encoded speech signal, the LPC encoded speech signal comprising a plurality of successive encoded signal intervals, each signal interval comprising a respective set of LPC coefficients and a respective set of excitation parameters representing the speech signal over a respective time interval, the apparatus comprising processing means and storage means for storing instructions for operation of the processing means, said instructions implementing functional blocks comprising:

a decoder for extracting LPC coefficients and excitation parameters for each successive encoded signal interval from the LPC encoded speech signal;

a first synthesis filter element operable to reconstruct speech signal intervals from the extracted LPC coefficients and excitation parameters, each reconstructed speech signal interval comprising a plurality of successive signal samples;

a speech detector for distinguishing reconstructed speech signal intervals containing speech sounds from reconstructed speech signal intervals containing no speech sounds;

a long window LPC analyzer operable to calculate long window LPC coefficients for at least the reconstructed speech signal intervals containing no speech sounds, the long window LPC coefficients for each reconstructed speech signal interval being based on samples of said reconstructed speech signal intervals and a plurality of reconstructed speech signal intervals preceding said reconstructed speech signal interval; and a second synthesis filter element operable to reconstruct speech signal intervals from the long window LPC coefficients and the extracted excitation parameters, each reconstructed speech signal interval comprising a plurality of successive signal samples;

the long window LPC analyzer and the second synthesis filter being switchable into an output signal path in response to detection by the speech detector of a reconstructed speech signal interval containing no speech sounds to provide an output speech signal interval processed by the long window LPC analyzer and the second synthesis filter, and being switchable out of the output signal path in response to detection by the speech detector of a reconstructed speech signal interval containing speech sounds to provide an output speech signal interval not processed by the long window LPC analyzer and the second synthesis filter.

16. Apparatus as defined in claim 15, wherein the functional blocks further comprise a low pass filter operable to low pass filter the speech signal intervals reconstructed from the long window LPC coefficients and the extracted excitation parameters.

17. Apparatus for processing an LPC encoded speech signal, the LPC encoded speech signal comprising a plurality of successive encoded signal intervals, each signal interval comprising a respective set of LPC coefficients and a respective set of excitation parameters representing the speech signal over a respective time interval, the apparatus comprising processing means and storage means for storing instructions for operation of the processing means, said instructions implementing functional blocks comprising:

a decoder for extracting LPC coefficients and excitation parameters for each successive encoded signal interval from the LPC encoded speech signal;

a long window LPC analyzer operable to compute long window LPC coefficients for at least the speech signal intervals containing no speech sounds from the extracted LPC coefficients for that signal interval and the extracted LPC coefficients for each of a plurality of preceding signal intervals;

a synthesis filter operable to reconstruct speech signal intervals from LPC coefficients and excitation parameters, each reconstructed speech signal interval comprising a plurality of successive signal samples;

a selector for selecting between the extracted LPC coefficients and the long window LPC coefficients for application to the synthesis filter; and a speech detector for distinguishing reconstructed speech signal intervals containing speech sounds from reconstructed speech signal intervals containing no speech sounds;

the selector being responsive to the speech detector to apply the extracted LPC coefficients to the synthesis filter upon detecting reconstructed speech signal intervals containing speech sounds and to apply the long window LPC coefficients to the synthesis filter upon detecting reconstructed speech signal intervals containing no speech sounds.

18. Apparatus as defined in claim 17, wherein the functional blocks further comprise a low pass filter operable to low pass filter at least the speech signal intervals reconstructed from the long window LPC coefficients and the extracted excitation parameters.

19. Apparatus as defined in claim 18, wherein the functional blocks further comprise another selector responsive to the speech detector to select between the low pass filtered reconstructed signal intervals and unfiltered reconstructed signal intervals.

20. A method for processing a speech signal comprising a plurality of successive signal intervals, each signal interval comprising a plurality of successive signal samples, the method comprising:

classifying each signal interval containing no speech sounds as a noise interval;

classifying each signal interval containing speech sounds as a speech interval;

calculating LPC coefficients for each speech interval based on a respective first plurality of samples comprising the samples of that speech interval;

calculating excitation parameters for each speech interval based on the samples of that speech interval and the LPC coefficients calculated for that speech interval;

calculating LPC coefficients for each noise interval based on a respective second plurality of samples comprising the samples of that noise interval and a plurality of preceding signal intervals; and calculating excitation parameters for each noise interval based on the samples of that noise interval and the LPC coefficients calculated for that noise interval;

wherein the each respective second plurality of samples contains at least ten times as many samples as each respective first plurality of samples.

* * * * *